US006255768B1

(12) United States Patent
Gorski et al.

(10) Patent No.: US 6,255,768 B1
(45) Date of Patent: Jul. 3, 2001

(54) COMPACT FIELD EMISSION ELECTRON GUN AND FOCUS LENS

(75) Inventors: Rich Gorski, Arlington Heights, IL (US); Keith D. Jamison, Austin, TX (US)

(73) Assignee: Extreme Devices, Inc., Austin, TX (US)

( * ) Notice: Subject to any disclaimer, the term of this patent is extended or adjusted under 35 U.S.C. 154(b) by 0 days.

(21) Appl. No.: 09/356,851

(22) Filed: Jul. 19, 1999

(51) Int. Cl.[7] ..... H01J 1/30; H01J 19/24

(52) U.S. Cl. ..... 313/414; 313/309; 313/336; 313/307

(58) Field of Search ..... 313/446, 447, 313/448, 449, 452, 336, 306, 309, 307, 351

(56) References Cited

U.S. PATENT DOCUMENTS

| | | | | |
|---|---|---|---|---|
| 3,753,022 | | 8/1973 | Fraser, Jr. | 313/311 |
| 4,178,531 | | 12/1979 | Alig | 313/309 |
| 4,498,952 | | 2/1985 | Christensen | 313/309 |
| 5,332,945 | | 7/1994 | True | 313/414 |
| 5,336,973 | * | 8/1994 | Leroux et al. | 313/447 |
| 5,343,113 | | 8/1994 | Chang | 313/414 |
| 5,430,347 | | 7/1995 | Kane et al. | 313/309 |
| 5,444,328 | * | 8/1995 | Van Zutphen | 313/446 |
| 5,528,103 | | 6/1996 | Spindt et al. | 313/309 |
| 5,552,659 | | 9/1996 | Macaulay et al. | 313/309 |
| 5,682,078 | | 10/1997 | Shishido | 313/336 |
| 5,717,275 | | 2/1998 | Takemura | 313/309 |
| 5,719,477 | | 2/1998 | Tomihari | 313/336 |
| 5,723,867 | | 3/1998 | Imura | 313/309 |
| 5,734,223 | | 3/1998 | Makishima et al. . | |
| 5,786,657 | | 7/1998 | Okamoto . | |
| 5,804,910 | * | 9/1998 | Tjaden et al. | 313/336 |
| 5,814,931 | | 9/1998 | Makishima | 313/336 |
| 5,850,120 | | 12/1998 | Okamoto | 313/336 |
| 5,877,594 | | 3/1999 | Miyano et al. . | |
| 5,929,557 | * | 7/1999 | Makishima et al. | 313/309 |
| 5,977,696 | | 11/1999 | Okamoto . | |
| 5,986,388 | * | 11/1999 | Makishima | 313/309 |

FOREIGN PATENT DOCUMENTS

| | | | |
|---|---|---|---|
| 0 840 345 | 5/1998 | (EP) . | |
| 09306376 | 11/1977 | (JP) | H01J/29/50 |
| 10-134702 | 5/1998 | (JP) . | |

OTHER PUBLICATIONS

De Wolf, David A., "Chapter 11: Electron Guns in Television and Other Cathode–Ray Tubes," Basics of Electron Optics, pp. 185–219, John Wiley & Sons, Inc.

D. E. Patterson, et al., "Advanced CVD Diamond Microtip Device for Extreme Applications", *Mat. Res. Soc. Symp. Proc.* vol. 509, (1998) pp. 65–75, (no month).

Iva m. Wilson, "Theoretical and Practical Aspects of Electron–Gun Design for Color Picture Tubes", *Transactions CE*. (Feb. 1975) pp. 32–38.

* cited by examiner

*Primary Examiner*—Michael H. Day
(74) *Attorney, Agent, or Firm*—Baker Botts L.L.P.

(57) ABSTRACT

A source of a focused electron beam is provided for use in a cathode ray tube (CRT) or vacuum microelectronic device. A carbon-based field emission cathode, extraction gate and focus lens are formed as an integrated structure using fabrication techniques that are used to form integrated circuits. An external focus lens is used to confine the beamlets from a large number of carbon-based surfaces. A convergence cup accelerates the beam toward a drift space and finally to a screen on a CRT or other device. The source may be much more compact than present CRT electron optics apparatus.

23 Claims, 2 Drawing Sheets

COMPACT FIELD EMISSION ELECTRON GUN AND FOCUS LENS

FIELD OF THE INVENTION

This invention pertains to electron guns and their use in devices such as cathode ray tubes (CRTs). More particularly, a field emission array is combined with integral electrodes and external electrodes to provide a compact source of a focused electron beam.

BACKGROUND OF THE INVENTION

A cathode ray tube (CRT) and any other device requiring an electron beam normally contains a hot filament to cause thermionic emission from a cathode. There has long been an interest in developing cold cathodes, depending on field emission of electrons, to replace the hot cathodes. For low current devices, such as scanning electron microscopes, there are a large number of patents describing field emission electron guns. For higher current applications, such as TV displays, prior art field emission cathodes, generally based on molybdenum and silicon, have not proven sufficiently robust for commercial applications. Tip damage occurs from ion back scattering caused by the presence of background gases and the tips fail when driven at high current densities.

It has been demonstrated that carbon-based microtip cathodes can be fabricated and used as a replacement for the molybdenum- or silicon-based microtip field emission cathodes. It has also been demonstrated that the diamond can be monolithically integrated with gated electrodes in a self-aligned structure, using integrated circuit fabrication techniques ("Advanced CVD Diamond Microtip Devices for Extreme Applications," *Mat. Res. Soc. Symp. Proc.,* Vol. 509 (1998).

Extraction of electrons from cold electron-emissive material by a gate electrode has been widely studied in recent years. Much of the work in cathode development was directed to electron sources for use in flat panel displays. U.S. Pat. No. 3,753,022 discloses a miniature directed electron beam source with several deposited layers of insulator and conductor for focusing and deflecting the electron beam. The deposited layers have a column etched through them to the point field emission source. The device is fabricated by material deposition techniques. U.S. Pat. No. 4,178,531 discloses a cathode ray tube having a field emission cathode. The cathode comprises a plurality of spaced, pointed protuberances, each protuberance having its own field emission producing electrode. Focusing electrodes are used to produce a beam. The structure produces a plurality of modulated beams that are projected as a bundle in substantially parallel paths to be focused on and scanned over the screen of a CRT. Manufacture using a photo resist or thermal resist layer is disclosed. U.S. Pat. No. 5,430,347 discloses a cold cathode field emission device having an electrostatic lens as an integral part of the device. The electrostatic lens has an aperture differing in size from the first size of the aperture of the gate electrode. The electrostatic lens system is said to provide an electron beam cross-section such that a pixel size of from approximately 2 to 25 microns may be employed. Computer model representations of the side elevation view of prior art electron emitters are shown.

Among relatively recent patents, U.S. Pat. No. 5,719,477 discloses conically shaped electron emitters wherein a control voltage can be applied independently to each group of the plurality of groups of cathodes and also to the gate electrodes. U.S. Pat. No. 5,723,867 discloses a gate electrode with the emissive surface in a cone recess with focusing electrodes on the surface above the recess. In one embodiment there is a "shield electrode." U.S. Pat. No. 5,814,931 likewise has the emitter in a "hollow" and focusing electrodes in four parts around the plurality of emitters. The emitter is a refractory metal such as tungsten. The focusing voltage varies during the scan angle when the electron emitter is used in a CRT. The focusing is designed to be more intense when the electron beam is in the peripheral part of a screen. Dividing the emitter electrode is also disclosed. U.S. Pat. No. 5,850,120 discloses a method of obtaining linearity in brightness while using an emitter following the Fowler-Nordheim type emission current. A secondary gate electrode has lower potential than a first gated electrode and the voltage between the cathode and the secondary gate electrode is proportional to the voltage between the cathode and the primary gate electrode. A ternary gate electrode is also disclosed, which is at a higher voltage to increase current and prevent secondary gate current.

Publication No. 09306376 from the Japanese Patent Office discloses electron beams emitted from conical electron sources and focused by a first focus electrode and accelerated by a second focusing electrode. Independent electric potentials of the focusing electrode and an anode are used to form a focus on a screen with a main lens, which is a conventional bipotential lens.

The book *Basics of Electron Optics* describes the principles of electron lenses, the factors limiting the quality of electron optics and, in Ch. 11, electron guns based on conventional hot cathodes that are used in television and other CRTs. In addition to the electron gun, which forms and focusses a beam, there is a drift region that brings the beam to a spot on the screen and a deflector or yoke that deflects the beam. The yoke of a CRT is not a part of this disclosure and will not be discussed further. The referenced book discusses the three regions in a CRT: (1) the beamforming region, which includes the cathode and electron optics lenses, which supplies a divergent beam of electrons; (2) the main lens region, which uses cylinder lenses, usually co-linear, to focus the divergent beam toward the display screen, and (3) the drift region, which is past the neck of the CRT and in which the redirected electrons move, without further forces, toward the screen. In such CRTs, there is a crossover region in the electron beam near the cathode and the beam is smeared by the combined effects of lens aberrations, space charge and thermal distribution of emitted electrons. The result of this smearing is less resolution in the image formed on the screen.

U.S. Pat. No. 5,343,113 discusses the introduction of the laminar flow electron gun, which produces a clearer, brighter display than the crossover guns. In a laminar flow gun, the electrons emitted from the cathode tend to flow in streamline paths until they are converged to a focus at the viewing screen. This patent, typical of field emission electron guns, discloses use of several lenses along the electron beam. The lenses significantly extend the required length of the gun.

What is needed is an electron gun having a cold cathode that has a long lifetime without requiring an ultra high-vacuum operating environment and having a lens arrangement that allows for a compact configuration and sufficiently high current in a small spot for many CRT applications, including TV.

SUMMARY OF THE INVENTION

A compact field emission electron gun that provides a beam current in the milliampere range and a spot size on a display screen in the 1–2-mm range is provided. Energies of the beam between 5 and 32 Kev and distances between the cathode and the screen of about 2 to 50 cm are expected in a CRT. The total length of the electron gun may be less than 3 cm. The electron gun includes a field emission cathode in the form of an array, preferably microtips of diamond or diamond-like carbon, and includes monolithically integrated extraction and focus electrodes. Electrons are extracted from field emission tips by a positive potential applied across a thin extractor gate positioned around each tip. The electrons are then focused into parallel beamlets by a monolithically integrated focus lens placed above the integrated extractor gate to form a laminar beam. An external focus lens and a convergence cup act to focus the beamlets and accelerate them to the anode/screen potential. The beam must be accelerated to anode potential so that the electrons have a kinetic energy sufficient to provide the level of phosphor screen brightness required. The external focusing lens also provides a converging force on the beam to compensate beam spreading due to space charge repulsion and to compensate for gun-to-gun focus differences caused by manufacturing tolerances.

DESCRIPTION OF PREFERRED EMBODIMENTS

Figure 1:
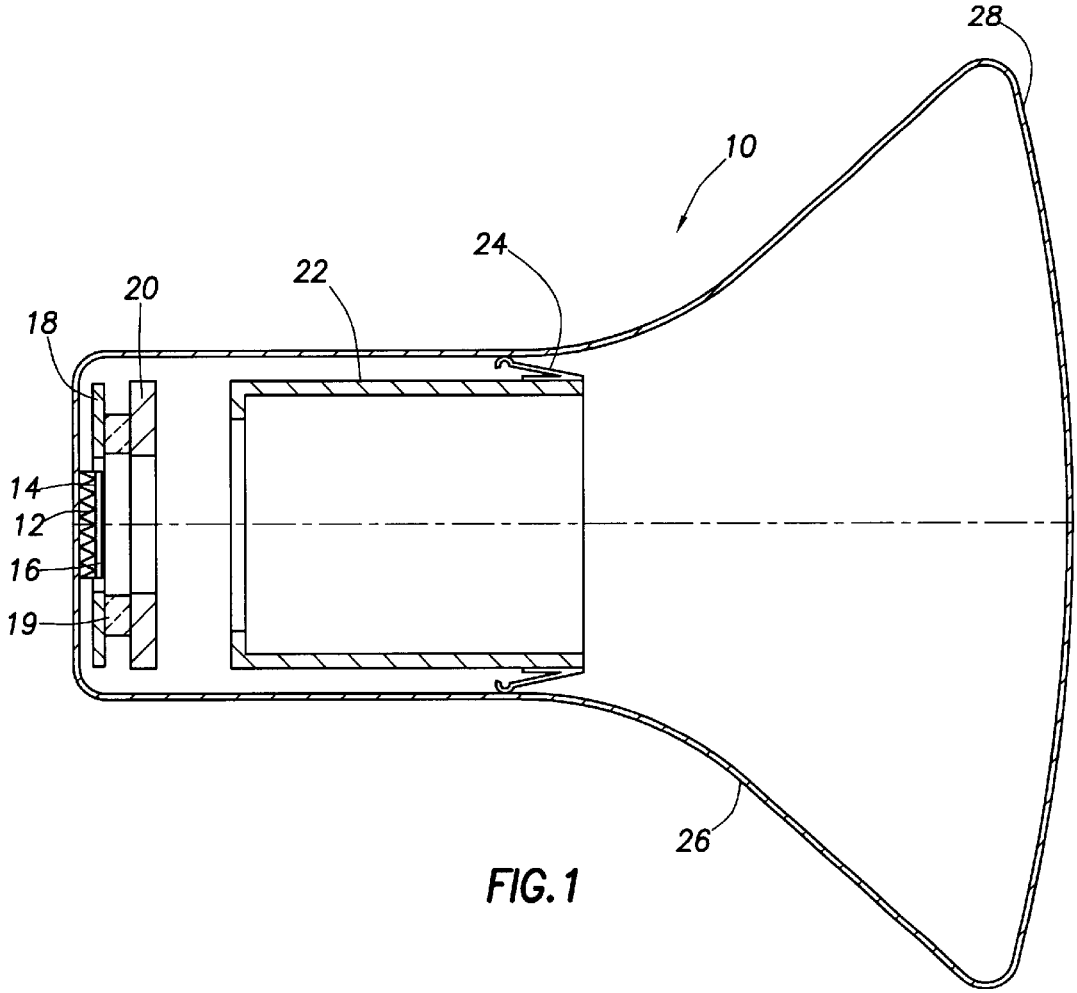
FIG. 1 is a drawing of the field emission array and external electrodes of the electron gun of this invention in a CRT.

Referring to FIG. 1, the compact field emission electron gun of this invention is shown installed in cathode ray tube (CRT) 10. Field emission cathode, preferably a carbon-based cathode 12, in the form of an emitter array, is monolithically formed with an integrated extractor gate layer 14 and integrated focus lens layer 16. Electrons are extracted from the field emission tips of cathode 12 by applying a positive potential to integrated extractor gate layer 14. The electrons are then focused into parallel beamlets by monolithically integrated focus lens 16 above the gates to form a laminar electron beam. Pierce-like electrode 18 is placed at a potential near (within about 150 volts) the potential of integrated focus lens 16 and is used to terminate the fringe fields and properly set the electric potential in front of the cathode. The shape of electrode 18 may be a simple disk with an aperture but it may be of a variety of shapes to achieve its purpose. External focus lens 20, placed above Pierce electrode 18, in combination with convergence cup 22, creates an external focusing effect forcing the individual beamlets together. Convergence cup 22, which is at anode potential, is placed above external focus lens 20 and accelerates the beam into the field-free drift region between the convergence cup 22 and phosphor coating 28. Snubber springs 24 electrically connect convergence cup 22 and internal conductive coating 26 (typically graphite) in the cathode ray tube. The electron beam emerging from the external focusing lens is brought to a small diameter focus at phosphor coating 28 on the interior of the display tube. The beamlets emerging from the integrated focus lens are essentially focused and in a near laminar flow state. The external focusing effect formed between external focus lens 20 and convergence cup 22 provides an additional focusing action and means to accelerate the beam up to anode potential. In contrast, a prior art electron gun using a hot thermionic cathode requires a focus lens with length anywhere from 15 to 60 mm to achieve beam characteristics similar to those of the beam emerging out of convergence cup 22 in the present apparatus.

Figure 2:
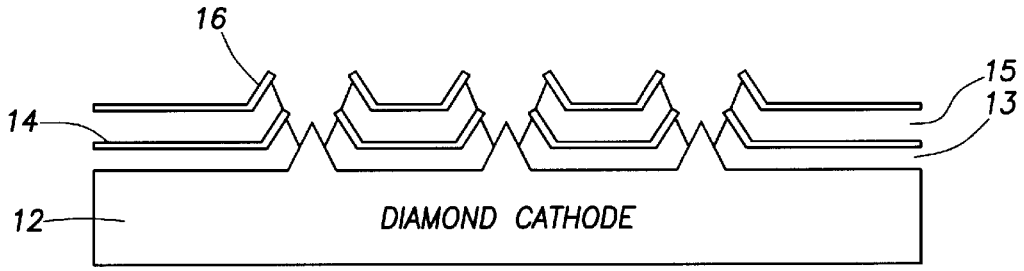
FIG. 2 shows details of the monolithically integrated field emission array with extraction and focussing electrodes.

FIG. 2 shows details of the cold cathode and monolithically integrated electrodes. Cathode 12 is preferably made of carbon-based material, as disclosed in pending and commonly owned patent applications Ser. Nos. 09/169,908and 09/169,909, both of which are hereby incorporated by reference herein for all purposes. Any material to produce a field emission cathode may be used. The average beam current from the array is determined by the number of gated tips used and the average emission current from each. Pierce wings 18 (FIG. 1) are preferably placed around the gated tip array to properly terminate the fringe fields.

As discussed further in the pending patent applications referenced above and incorporated by reference herein, gate electrode 14 serves to provide a high electric field at the tips of the array made of the carbon-based cathode. Dielectric layers 13 and 15 are formed between carbon-based cathode 12 and integrated extractor gate layer 14 and between integrated gate layer 14 and integrated focus lens layer 16, respectively, as shown in FIG. 2. Dielectric layers 13 and 15 are preferably formed from silicon dioxide and electrodes 14 and 16 are preferably formed from molybdenum or other metal, using techniques well known in industry.

The apparatus described herein is to be used as a replacement for the conventional thermionic electron guns used in cathode ray tubes. In a preferred embodiment, the field emission cathode is a 0.25 mm-diameter circular array containing 1,000 evenly spaced pyramidal tips about two microns wide and about 1.4 microns tall. Alternatively, the pyramidal tips may be replaced by a flat surface having the same area as the base of a pyramid. The pyramidal tips and substrate are composed of a diamond-like carbon formed by the methods set out in the referenced patent applications. The distance between tips is preferably about 6 microns. The thickness of silicon dioxide insulating layers 13 and 15 is preferably about two microns. Pierce wing 18 preferably has the same potential as integrated focusing lens layer 16. The potentials of integrated extractor gate layer 14 and integrated focus lens layer 16 are preferably set such that parallel beamlets of electrons emerge from the integrated structure.

As disclosed in the referenced pending patent applications, the emission layer of the carbon-based electron emitter of this invention is sequentially covered by a first dielectric layer, electron extraction electrode layer, second dielectric layer and focusing electrode layer. Ohmic contact (not shown) is made to the back of the carbon-based emitter. Methods for fabricating the multiple dielectric and electrode layers and for creating the openings in the layers are those conventionally used in semiconductor fabrication art. It is preferable to create many electron guns on a single carbon wafer before sawing or otherwise dividing the multilayered wafer into separate electron guns. A typical electron gun will contain openings in the layers having a diameter between 1 and 4 microns and the openings will have a pitch (distance between centers of openings) in the range from about 6 microns to about 10 microns, depending on the total current required. Pitch can be as small as only slightly greater than gate diameters, but calculations and results indicate that pitch should be at least about twice the diameter of gate openings. For example, an electron gun may contain 1 micron openings with a 10-micron pitch in a 100-X 100 array of openings, or 10,000 openings. Still, thousands of electron guns can be produced on a single 2-inch diameter or larger carbon wafer.

The parallel beam of electrons travels toward external focus lens 20, which is preferably placed approximately 1 mm above the gated tip array, but may be at a distance from about 0.25 mm to about 2.0 mm. Ceramic spacer 19 serves to separate Pierce wing 18 and external focus lens 20. External focus lens 20 preferably has an aperture diameter of about 6 mm, but may have a diameter from about 0.5 mm to about 8 mm and has a thickness of about 0.6 mm. The external focus lens will be placed at a potential in the range from about −1,000 volts to about 5,000 volts. The purpose of this lens is to force the individual beams of electrons together, compensating for space charge repulsion, so they form a focused spot on screen 28. Convergence cup 22 may be placed about 3 millimeters above external focus lens 20. The convergence cup will have the same potential as the conductive coating inside the cathode ray tube, which is often in the range of about 5,000 to about 30,000 volts, to form a field-free region for the remainder of the electron beam path. The opening in convergence cup 22 is preferably about 12 mm, but may be in the range from about 0.5 mm to about 15 mm. Preferably, the potential of the lenses will be such that the focused spot will have a minimum circle-of-least-confusion formed on screen 28.

The electron beam produced by the apparatus of FIG. 1 was predicted using modified Electron Beam Simulation (EBS) software. This software solves and computes electron trajectories through the computed electric field using LaPlace's and Poisson's equations for a variety of boundary conditions and beam currents. For such simulation, it is necessary to characterize the electron emission from the cathode in terms of its tangential energy spectrum. The electron optics for the Gated/Focused Microtip Array (GFMA), shown in FIGS. 1 and 2 as 12, 14 and 16, can be designed so as to produce a laminar electron beam or a beam with a very small angle of divergence. The design should be optimized based on experimental measurements of tangential energy from a particular design of GFMA. The configuration of FIG. 1 will allow reduction of the electron gun length by as much as 5 cm compared with prior art guns. The electron optics design required for the GFMA is different from that of the crossover design discussed above. The crossover design dictates that a smaller diameter array is preferred. In the GFMA concept provided here a minimum array diameter below which space charge repulsion becomes overpowering and controls the beam focus can be selected based on computer simulation of the electron beam characteristics. There is also a maximum diameter beam, limited by spherical aberration of the external focusing lens and ultimately limited by the neck diameter of a CRT. Other important factors that affect space charge repulsion and spherical aberration are maximum beam current requirements, anode voltage and the drift distance from the gun end to screen 28 shown in FIG. 1.

Figure 3:
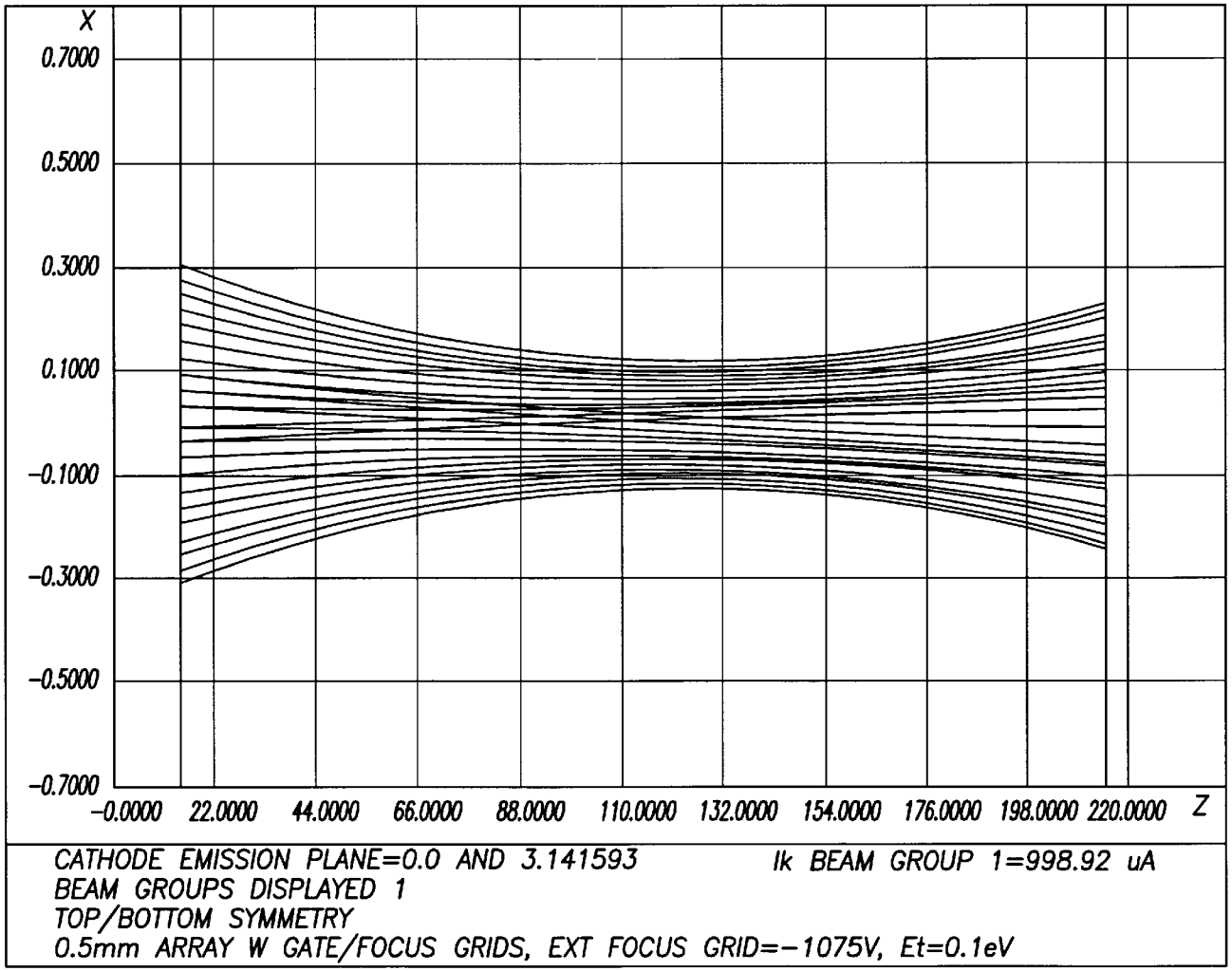
FIG. 3 shows results of a computer simulation of beam geometry for a device such as shown in FIG. 1.

Computer simulations for a variety of conditions in the electron beam have been performed using the EBS software modified to simulate multiple field emission tips. In these calculations, the GFMA is assumed to be capable of producing an energy spectrum such that the maximum tangential energy in a single focused beamlet emerging from the array is less than 0.5 eV. The simulations also show that higher tangential energies and higher current levels cause excessive spreading of the electron beam under the conditions used in the simulations. FIG. 3 shows a calculated beam of 1 mA from a 1.0 mm diameter GFMA such as shown in FIG. 1 with external focus lens 20 at −1075 V and the convergence cup 22 at +25 kV. The plot shows a beam 0.5 mm wide at a screen 22 cm from the cathode emission plane. For this calculation, the external focus lens was at a position of approximately 0.4 mm from the end of the GFMA.

The computer simulation results show that spherical aberration of the external focus lens region and, when beam current is greater than 0.3 mA, space charge repulsion in the drift region are conditions to be used for optimization. Space charge repulsion increases as beam current density and distance to the screen increases, and decreases as accelerating voltage of the anode increases. Spherical aberration, which is a decrease in focal length with beam height within a lens, increases as the beam diameter in the lens increases. Unfortunately, spherical aberration has less of an effect with smaller beam diameter and space charge repulsion is more important with a smaller beam diameter. Therefore, optimal electron optics design will be one that balances the two effects. Preferably, an optimization for each application of the gun in a CRT is performed. Focus lens configurations and positions produce varying degrees of spherical aberration; the specific location of the focus lens will be determined after experimental and simulation results are available. For a particular CRT, the current required, the length of the beam and the method of deflection would determine final design parameters of the electron gun. With the cold cathode of this invention, current requirements can be met for a much larger variety of applications for CRTs than those that could be obtained with the prior art cold cathodes. The general procedures required for such designs are discussed in "Theoretical and Practical Aspects of Electron-gun Design for Color Picture Tubes," *Trans. CE,* February 1975. where design procedures are applied to a typical prior art electron gun. The transverse energy will be minimized in the present design by the integrated construction of carbon tips 12, integrated extractor gate 14 and integrated focus lens 16, all integrally formed by methods described in pending applications Ser. Nos. 09/169,908 and 09/169,909 and incorporated by reference herein.

The important properties of the electron gun of this invention as compared with other field emitter devices include the ability to produce high-current density electron beams with controlled divergence sufficient to satisfy a wide range of CRT requirements and to operate reliably in the vacuum environment typical of CRTs. A key feature of the present invention is the short external focus lens, which brings the beamlets from all the tips together and allows focusing of the beam in the far field. Other advantages include: ability to fabricate the cathode and integrated lenses using techniques developed in the microelectronics industry, which will reduce the fabrication costs, long lifetime cathode, high brightness and small spot size, high bandwidth because of small capacitance of the field emitter array, and a source of electrons that can be tested prior to assembly into a CRT.

The foregoing disclosure and description of the invention are illustrative and explanatory thereof, and various changes in the details of the illustrated apparatus and construction and method of operation may be made without departing from the spirit of the invention.

What we claim is:

1. A source of a focused electron beam, comprising:

a field emission cathode having a continuous emitter region around a central axis in the direction of the electron beam;

a first dielectric layer on the field emission cathode;

an integrated extractor gate and an integrated focus lens, the gate and lens being separated by a second dielectric layer and being monolithically integrated with the dielectric layers and the cathode;

an external focus lens having a selected thickness and an opening therethrough and disposed at a selected distance from the integrated focus lens;

a convergence cup having a selected thickness and an opening therethrough and disposed at a selected distance from the external focusing electrode; and electrical connections to the cathode, integrated gate and lens, external lens and convergence cup.

2. The source of claim 1 wherein the field emission cathode is carbon-based.

3. The source of claim 1 further comprising a Pierce electrode disposed near the plane of the integrated focus lens for shaping the fringe fields near the field emission cathode.

4. The source of claim 1 wherein the first and second dielectric layers have a thickness in the range from about 1 micrometer to about 4 micrometers.

5. The source of claim 1 wherein the external focus lens has a thickness in the range from about 0.3 mm to about 1.0 mm.

6. The source of claim 1 wherein the convergence cup is less than 10 mm in front of the cathode.

7. The source of claim 1 wherein the distance from the cathode to the external focus lens is less than 3 cm.

8. A method for providing a focused electron beam, comprising the steps of:

providing a field emission cathode, the field emission cathode having a continuous emitter region around a central axis in the direction of the electron beam, a first dielectric layer on the field emission cathode, an integrated extractor gate for extraction of electrons and an integrated focus lens for focusing of electrons, the gate and lens being separated by a second dielectric layer and being monolithically integrated with the dielectric layers and the cathode, providing an external focus lens, the external lens having a selected thickness and an opening therethrough and disposed at a selected distance from the integrated focus lens, a convergence cup and electrical connections;

connecting the cathode to ground; and applying selected voltages to the integrated gate and integrated lens, the external focus lens and convergence cup so as to produce a focused electron beam.

9. The method of claim 8 wherein the field emission cathode is carbon-based.

10. The method of claim 8 wherein the voltage applied to the extractor gate is in the range from about 20 volts to about 120 volts.

11. The method of claim 8 wherein the voltage applied to the integrated focus lens is in the range from about −10 volts to about +200 volts.

12. The method of claim 8 wherein the voltage applied to the external focus electrode is in the range from about −1500 volts to about +5000 volts.

13. The method of claim 8 wherein the voltage applied to the Pierce electrode is within 150 volts of the voltage applied to the integrated focusing electrode.

14. A source of a focused electron beam, comprising:

a field emission cathode having a continuous emitter region around a central axis in the direction of the electron beam, the cathode being carbon-based:

a first dielectric layer on the field emission cathode;

an integrated extractor gate and an integrated focus lens, the gate and lens being separated by a second dielectric layer and being monolithically integrated with the dielectric layers and the cathode;

an external focus lens having a selected thickness and an opening therethrough and disposed at a selected distance from the integrated focus lens;

a convergence cup having a selected thickness and an opening therethrough and disposed at a selected distance from the external focusing electrode; and electrical connections to the cathode, integrated gate and lens, external lens and convergence cup.

15. The source of claim 14 further comprising a Pierce electrode disposed near the plane of the integrated focus lens for shaping the fringe fields near the field emission cathode.

16. The source of claim 14 where the first and second dielectric layers have a thickness in the range from about 1 micrometer to about 4 micrometers.

17. The source of claim 14 wherein the external focus lens has a thickness in the range from about 0.3 mm to about 1.0 mm.

18. The source of claim 14 wherein the convergence cup is less than 10 mm in front of the cathode.

19. A method for providing a focused electron beam, comprising the steps of:

providing a field emission cathode, the field emission cathode having a continuous emitter region around a central axis in the direction of the electron beam and being carbon-based, a first dielectric layer on the field emission cathode, an integrated extractor gate for extraction of electrons and an integrated focus lens for focusing of electrons, the gate and lens being separated by a second dielectric layer and being monolithically integrated with the dielectric layers and the cathode, providing an external focus lens, the external lens having a selected thickness and an opening therethrough and disposed at a selected distance from the integrated focus lens, a convergence cup and electrical connections;

connecting the cathode to ground; and applying selected voltages to the integrated gate and integrated lens, the external focus lens and convergence cup so as to produce a focused electron beam.

20. The method of claim 19 wherein the voltage applied to the extractor gate is in the range from about 20 volts to about 120 volts.

21. The method of claim 19 wherein the voltage applied to the integrated focus lens is in the range from about −10 volts to about +200 volts.

22. The method of claim 19 wherein the voltage applied to the external focus electrode is in the range from about −1500 volts to about +5000 volts.

23. The method of claim 19 wherein the voltage applied to the Pierce electrode is within 150 volts of the voltage applied to the integrated focusing electrode.

* * * * *